US011588238B2

(12) United States Patent
Rogers

(10) Patent No.: US 11,588,238 B2
(45) Date of Patent: Feb. 21, 2023

(54) SIDELOBE-CONTROLLED ANTENNA ASSEMBLY

(71) Applicant: THE BOEING COMPANY, Chicago, IL (US)

(72) Inventor: John E. Rogers, Huntsville, AL (US)

(73) Assignee: THE BOEING COMPANY, Chicago, IL (US)

( * ) Notice: Subject to any disclaimer, the term of this patent is extended or adjusted under 35 U.S.C. 154(b) by 505 days.

(21) Appl. No.: 16/564,180

(22) Filed: Sep. 9, 2019

(65) Prior Publication Data

US 2021/0075103 A1 Mar. 11, 2021

(51) Int. Cl.
*H01Q 3/28* (2006.01)
*H01Q 21/00* (2006.01)

(52) U.S. Cl.
CPC ..... *H01Q 3/28* (2013.01); *H01Q 21/0075* (2013.01)

(58) Field of Classification Search
CPC ..... H01Q 3/28; H01Q 21/065; H01Q 9/045; H01Q 21/22; H01Q 21/061; H01Q 9/0407; H01Q 21/0087; H01Q 1/48; H01Q 21/0075
See application file for complete search history.

(56) References Cited

U.S. PATENT DOCUMENTS

| | | | | |
|---|---|---|---|---|
| 6,208,234 | B1 * | 3/2001 | Hunt | C23C 16/453 252/514 |
| 9,059,505 | B1 * | 6/2015 | Asrani | H04B 1/3888 |
| 9,395,727 | B1 * | 7/2016 | Smith | G01S 13/42 |
| 9,772,422 | B2 | 9/2017 | Hull | |
| 10,062,972 | B1 * | 8/2018 | Strassner, II | H01Q 3/28 |
| 2016/0261043 | A1 * | 9/2016 | Sazegar | H01Q 3/24 |
| 2017/0279192 | A1 * | 9/2017 | Taniguchi | H01Q 1/243 |
| 2018/0145422 | A1 * | 5/2018 | Rofougaran | H01Q 21/065 |
| 2018/0159203 | A1 * | 6/2018 | Baks | H01Q 1/2283 |
| 2018/0248270 | A1 * | 8/2018 | Ding | H01Q 21/061 |
| 2019/0097302 | A1 * | 3/2019 | Berge | H01Q 9/0407 |
| 2019/0115664 | A1 * | 4/2019 | Veihl | H01Q 5/385 |
| 2019/0304901 | A1 * | 10/2019 | Hwang | H01Q 21/065 |
| 2020/0052390 | A1 * | 2/2020 | Ahmadloo | H01Q 21/065 |

OTHER PUBLICATIONS

Fonseca, M. A., et al., "Flexible wireless passive pressure sensors for biomedical applications," Hilton Head 2006, Jun. 2006.
Abad, E., et al., "Flexible tag microlab development: gas sensors integration in RFID flexible tags for food logistics," Sensors and Actuators B, Jul. 2007.

(Continued)

*Primary Examiner* — Renan Luque
(74) *Attorney, Agent, or Firm* — The Small Patent Law Group LLC; Joseph M. Butscher

(57) ABSTRACT

An antenna assembly includes a plurality of antenna elements, a microstrip feed network that is configured to supply power to the plurality of antenna elements, and one or more resistors disposed within the microstrip feed network proximate to one or more of the plurality of antenna elements. The resistors are configured to control sidelobes of the antenna assembly.

20 Claims, 3 Drawing Sheets

(56) References Cited

OTHER PUBLICATIONS

Rida, A., et al., "Conductive inkjet-printed antennas on flexible low-cost paper-based substrates for RFID and WSN applications," IEEE Antennas and Propagation Magazine, Jun. 2009.
Schwerdt, H. N., et al., "A fully passive wireless microsystem for recording of neuropotentials using RF backscattering methods," Journal of Microelectromechanical Systems, Aug. 2011.
Rose, D. P., et al., "Adhesive RFID sensor patch for monitoring of sweat electrolytes," IEEE Transactions on Biomedical Engineering, Jun. 2015.
Bito, J., et al., "Ambient RF energy harvesting from a two-way talk radio for flexible wearable wireless sensor devices utilizing inkjet printing technologies," IEEE Transactions on Microwave Theory and Techniques, Dec. 2015.
Escobedo, P., et al., "Flexible passive near field communication tag for multigas sensing," Analytical Chemistry, Dec. 2016.
Xu, G., et al., "Passive and wireless near field communication tag sensors for biochemical sensing with smartphone," Sensors and Actuators B, Feb. 2017.
Pozar, D.M., "Microstrip antenna aperture-coupled to a microstrip line," Electronics Letters, Jan. 1985.
Pozar, D.M., Kaufman, B., "Increasing the bandwidth of a microstrip antenna by proximity coupling," Electronics Letters, Apr. 1987.
Hallil, H., et al., "Feasibility of wireless gas detection with an FMCW Radar interrogation of passive RF gas sensor," IEEE Sensors, Nov. 2010.
Iwasaki, H., "A circularly polarized small-size microstrip antenna with a cross slot," IEEE Transactions on Antennas and Propagation, Oct. 1996.
Papapolymerou, I., et al., "Micromachined patch antennas," IEEE Transactions on Antennas and Propagation, Feb. 1998.
Gauthier, G.P., et al., "A 94 GHz aperture-coupled micromachined microstrip antenna," IEEE Transactions on Antennas and Propagation, Dec. 1999.
Cook, B.S., et al., "Multilayer inkjet printing of millimeter-wave proximity-fed patch arrays on flexible substrates," IEEE Antennas and Wireless Propagation Letters, Oct. 2013.
Sorkherizi, M.S., et al., "Planar high-efficiency antenna array using new printed ridge gap waveguide technology," IEEE Transactions on Antennas and Propagation, Jul. 2017.
Yi, X., et al., "Passive wireless smart-skin sensor using RFID-based folded patch antennas," International Journal of Smart and Nano Materials, Mar. 2011.
Zhang, N., et al., "Temperature sensor based on 4H-silicon carbide pn diode operational from 20C to 600C," Applied Physics Letters, Feb. 2014.
Rogers, J.E., et al., "A passive wireless microelectromechanical pressure sensor for harsh environments," Journal of Microelectromechanical Systems, Feb. 2018.
Pozar, Voda, "A rigorous analysis of a microstripline fed path antenna," IEEE Transations on Antennas and Propagation, Dec. 1987.
Davidovitz, M., Lo, Y.T. "Rigorous analysis of a circular patch antenna excited by a microstrip transmission line," IEEE Transactions on Antennas and Propagation, Aug. 1989.
Patterson, C.E., et al. "A lightweight X-band organic antenna array with integrated SiGe amplifier," IEEE Radio and Wireless Symposium 2010, Jan. 2010.
Patterson, C.E., et al "Implementation of a low cost, lightweight X-band antenna with integrated SiGe RF electronics," IEEE Geoscience and Remote Sensing Symposium 2010, Jul. 2010.
Morcillo, C.A.D., et al. "An ultra-thin, high-power, and multilayer organic antenna array with T/R functionality in the X-band," IEEE Transactions on Microwave Theory and Techniques, Dec. 2012.
Stephen Horst, et al., "Beam-Shaping of Planar Array Antennas Using Integrated Attenuators", 2007 Electronic Components and Technology Conference, pp. 165-168.

* cited by examiner

SIDELOBE-CONTROLLED ANTENNA ASSEMBLY

FIELD OF EMBODIMENTS OF THE DISCLOSURE

Embodiments of the present disclosure generally relate to antenna assemblies, and more particularly, to antenna assemblies that are configured to control (for example, suppress) sidelobes.

BACKGROUND OF THE DISCLOSURE

An antenna typically includes an array of conductors electrically connected to an electronic receiver or a transmitter. An electronic transmitter provides a time-varying voltage to terminals of the antenna, which, in response, radiates electromagnetic radio waves at a frequency corresponding to the time-varying voltage. Alternatively, as radio waves are received by the antenna, a time-varying voltage corresponding to the frequency of the radio wave is generated at the terminals, which, in turn is provided to the electronic receiver. Various types of known passive antennas are configured to transmit and receive radio waves with such a reciprocal behavior.

In some aerospace applications, there is a need for antennas that are capable of being positioned on conformal or non-planar surfaces, such as wings and fuselages of aircraft. Small aircraft, such as unmanned aerial vehicles (UAVs) or drones, in particular, have surfaces with low radii of curvature. Such aircraft typically need light weight antennas with low aerodynamic drag and low visibility. Further, various surfaces of aircraft may be formed from conductive or carbon fiber materials, which are known to change the electrical behavior of antennas, such as monopole and dipole antennas and derivatives (for example, whip, blade, Yagi, and other such antennas).

In certain applications, such as radar and imaging, an antenna is configured to direct energy in a particular direction. A typical antenna array generates a main beam and sidelobes. However, the sidelobes may emit power in undesired directions.

Active electronically steerable antennas (AESAs) are electronically configured to reduce sidelobes. However, AESAs typically consume substantial power and are costly.

SUMMARY OF THE DISCLOSURE

A need exists for a cost-effective antenna assembly that is configured to efficiently reduce sidelobes.

With that need in mind, certain embodiments of the present disclosure provide an antenna assembly that includes a plurality of antenna elements, a microstrip feed network that is configured to supply power to the plurality of antenna elements, and one or more resistors disposed within the microstrip feed network proximate to one or more of the plurality of antenna elements. The resistor(s) are configured to control sidelobes of the antenna assembly. The resistor(s) may be printed resistive elements embedded within the antenna assembly.

In at least one embodiment, the plurality of antenna elements are disposed on a first dielectric above the microstrip feed network. The microstrip feed network and the one or more resistors are disposed on a second dielectric below the first dielectric.

The resistor(s) may be disposed in power inlet segments that connect to the one or more of the plurality of antenna elements.

In at least one embodiment, a plurality of resistors are proximate to a subset of the antenna elements located at or otherwise proximate to a periphery of the antenna assembly. In at least one embodiment, a plurality of resistors are disposed in the microstrip feed network proximate to corners of the antenna assembly.

In at least one embodiment, the plurality of antenna elements include corner antenna elements, peripheral interior antenna elements between the corner antenna elements, and interior main antenna elements proximate to a center of the antenna assembly. The resistors are not proximate to the interior main antenna elements. A first plurality of resistors may be proximate to the corner antenna elements. A second plurality of resistors may be proximate to the peripheral interior antenna elements.

In at least one embodiment, the antenna assembly also includes a ground plane disposed below the microstrip feed network.

Certain embodiments of the present disclosure provide a method of controlling sidelobes of an antenna assembly. The method includes providing a plurality of antenna elements, supplying power to the plurality of antenna elements by a microstrip feed network, and disposing one or more resistors within the microstrip feed network proximate to one or more of the plurality of antenna elements.

DETAILED DESCRIPTION OF THE DISCLOSURE

The foregoing summary, as well as the following detailed description of certain embodiments, will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Certain embodiments of the present disclosure provide an antenna assembly including one or more resistors proximate to one or more antenna elements. The resistors are configured to control (for example, suppress) sidelobes. In at least one embodiment, the antenna assembly includes an aperture coupled antenna element with an inclusive slot, a microstrip feed network embedded in a radio frequency (RF) board, one or more resistors (such as printed resistive elements) disposed within the feed network, and a reference ground plane on a backside of the RF board. The antenna element has an inclusive slot for decreasing the axial ratio of the antenna element, which reduces the polarization loss. The reference ground plane minimizes or otherwise reduces any change in the electrical behavior of the antenna element, such as may otherwise be caused by environmental surfaces.

In at least one embodiment, the resistors are printed resistive elements that are disposed on an embedded RF microstrip feed network. The resistors control the gain pattern of the antenna assembly.

The antenna assembly may be manufactured using a combination of additive (for example, printing, film deposition, or the like) and subtractive (for example, wet etching, milling, laser etching, or the like) processes.

In at least one embodiment, the antenna assembly has a low cross-polarization and includes one or more proximity-coupled antenna elements on a surface of an RF board. An embedded microstrip feed network within the RF board may be proximity-coupled to the antenna elements. Optionally, the antenna elements may be edge-fed to the microstrip feed network. A ground plane on the backside of the RF board provides efficient signal propagation along the microstrip feed network.

Figure 1:
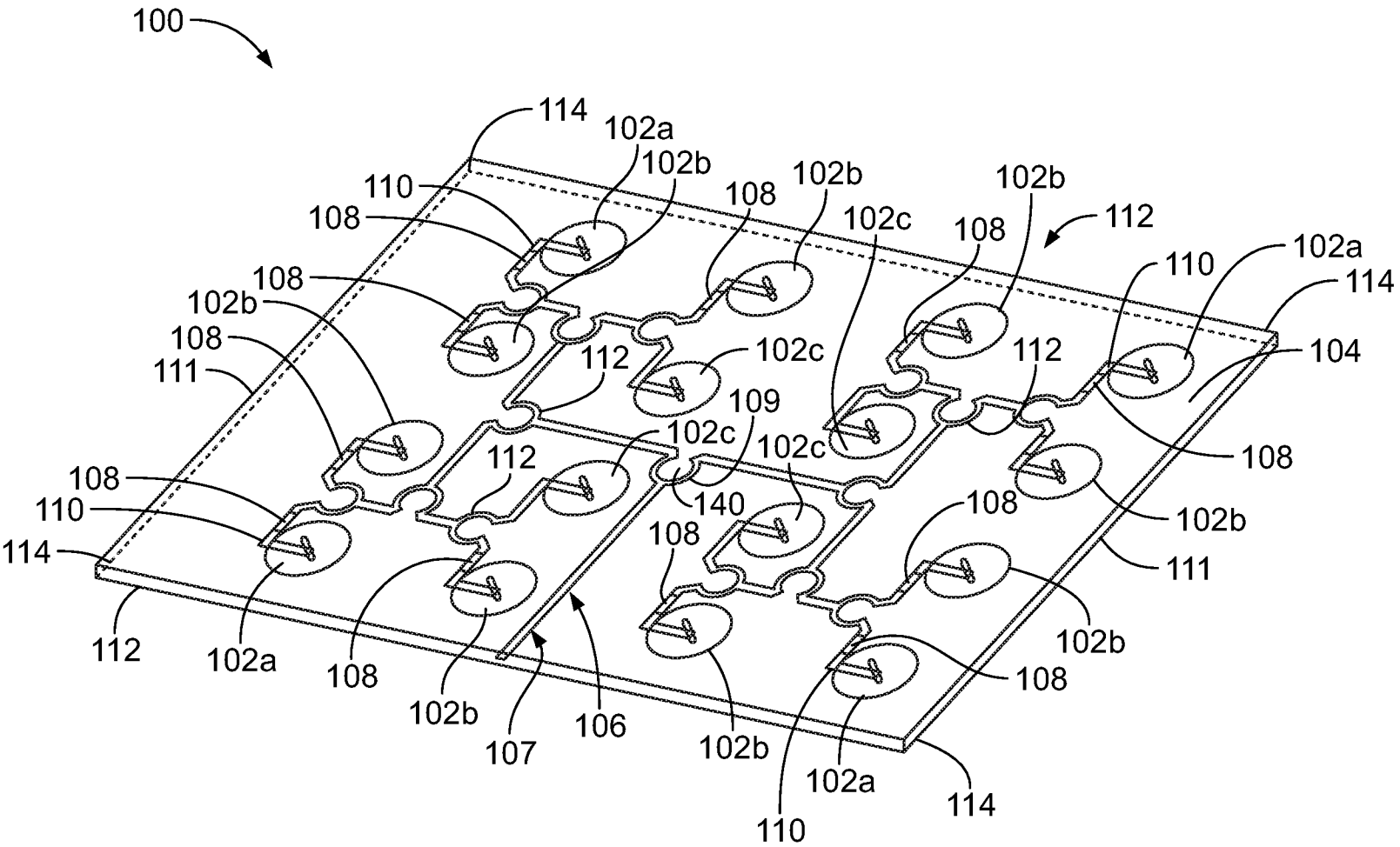
FIG. 1 illustrates a perspective top view of an antenna assembly, according to an embodiment of the present disclosure.

FIG. 1 illustrates a perspective top view of an antenna assembly 100, according to an embodiment of the present disclosure. The antenna assembly 100 includes a plurality of layers. For the sake of clarity, various layers of the antenna assembly 100 are shown transparent in order to show internal components.

The antenna assembly includes a plurality of antenna elements 102 disposed on a first dielectric 104. A microstrip feed network 106 is embedded within the antenna assembly 100 underneath the antenna elements 102. In this manner, the antenna elements 102 are proximity-coupled to the microstrip feed network 106. Alternatively, the antenna elements 102 and the microstrip feed network 106 may be on a common layer, such that the antenna elements 102 are edge-fed in relation to the microstrip feed network 106.

The microstrip feed network 106 includes a central power inlet 107, which is configured to receive (or transmit) RF power. The central power inlet 107 connects to a central power divider 109 that distributes power to the antenna elements 102. The microstrip feed network 106 may include a plurality of power dividers 112.

As shown, the antenna assembly 100 may be a 4×4 array, including a 16 antenna elements 102. Optionally, the antenna assembly 100 may include more or less antenna elements than shown. For example, the antenna assembly 100 may be a 2×2 array having 4 antenna elements, an 8×8 array having 64 antenna elements, and so on.

In order to control sidelobes, a resistor 108 is disposed in the microstrip feed network 106 proximate to an antenna element 102. For example, a resistor 108 is disposed in a power inlet segment 110 that connects to an antenna element 102. In at least one embodiment, the resistor 108 is a printed resistive element that is printed onto or into the power inlet segment 110 or other such portion of the microstrip feed network 106.

In at least one embodiment, the antenna assembly 100 includes resistors 108 proximate to a subset of the antenna elements 102 located at, or otherwise proximate to, a periphery 111 of the antenna assembly 100. For example, a resistor 108 is disposed in the microstrip feed network 106 in relation to antenna elements 102 located at corners 114 of the antenna assembly 100. As shown in FIG. 1, the antenna assembly 100 may include four resistors 108 proximate to four antenna elements 102 located at four corners 114.

The resistors 108 may have the same or similar resistances. For example, each of the resistors 108 may have the same resistance. Optionally, the resistances of at least some of the resistors 108 may differ.

In operation, the resistors 108 control (for example, suppress) power supplied to the outer (that is, at the periphery) antenna elements 102 associated with the resistors 108. By suppressing the power supplied to the outer antenna elements 102, sidelobes are suppressed. It has been found that resistors 108 suppress sidelobes, particularly when compared to an antenna assembly that does not include resistors proximate to one or more antenna elements. As an example, the antenna assembly 100 including resistors 108 proximate to the corner antenna elements 102*a* exhibits an antenna gain of approximately 14.6 dBi and sidelobes of approximately −17 dBc. In comparison, a 4×4 antenna assembly without the resistors exhibits an antenna gain of approximately 16.1 dBi and sidelobes of approximately −11.3 dBc. Thus, it has been found that the resistors 108 substantially suppress sidelobes.

The antenna assembly 100 reduces sidelobes by reducing power levels of certain antenna elements 102 through the resistors 108. For example, a 4×4 array as shown may have the power levels of the four corner antenna elements 102 reduced by the resistors 108. Generally, power levels of the antenna elements 102 closest to the center 140 of the antenna assembly 100 (such as the interior main antenna elements 102*c*) are not reduced.

Optionally, resistors 108 may also be disposed within the microstrip feed network 106 proximate to antenna elements 102 between the antenna elements 102 at the four corners 114 (that is, the corner antenna elements 102*a*). For example, resistors 108 may be disposed within the microstrip feed network 106 proximate to peripheral interior antenna elements 102*b*. The resistivities of the resistors 108 proximate to the peripheral interior antenna elements 102*b* may be the same or different than the resistivities of the resistors 108 proximate to the corner antenna elements 102*a*. For example, the resistances of the resistors 108 proximate to the corner antenna elements 102*a* may be higher than the resistances of the resistors 108 proximate to the peripheral interior antenna elements 102*b*, so as to provide a desired gain pattern.

Alternatively, the antenna assembly 100 may not include resistors 108 in the microstrip feed network proximate to the peripheral interior antenna elements 102*b*. In at least one other embodiment, resistors 108 may be disposed in the microstrip feed network 106 proximate to the power dividers 112 that distribute power to the corner antenna elements 102*a* and the peripheral interior antenna elements 102*b* (instead of, or in addition to, resistors 108 at power inlet segments 110).

As shown, interior main antenna elements 102*c*, which are surrounded by the corner antenna elements 102*a* and the peripheral interior antenna elements 102*b*, are configured to receive full RF power. That is, there are no resistors proximate to the interior main antenna elements 102*c*. As such, the interior main antenna elements 102*c* propagate signals at a desired frequency in a desired direction, while the resistors 108 proximate to the corner antenna elements 102*a* and the peripheral interior antenna elements 102*b* control or otherwise suppress sidelobes that may otherwise be generated by the corner antenna elements 102*a* and the peripheral interior antenna elements 102*b*.

The interior main antenna elements 102*c* are proximate to a center 140 of the antenna assembly 100. The resistors 108 are not proximate to the interior main antenna elements 102*c*. As such, the resistors 108 do not suppress power supplied to the interior main antenna elements 102*c*.

In at least one embodiment, the antenna assembly 100 also includes a ground plane disposed on a backside. For example, the ground plane may be distally located from the antenna elements 102. The antenna assembly 100 may include four dielectric layers, as described below.

Figure 2:
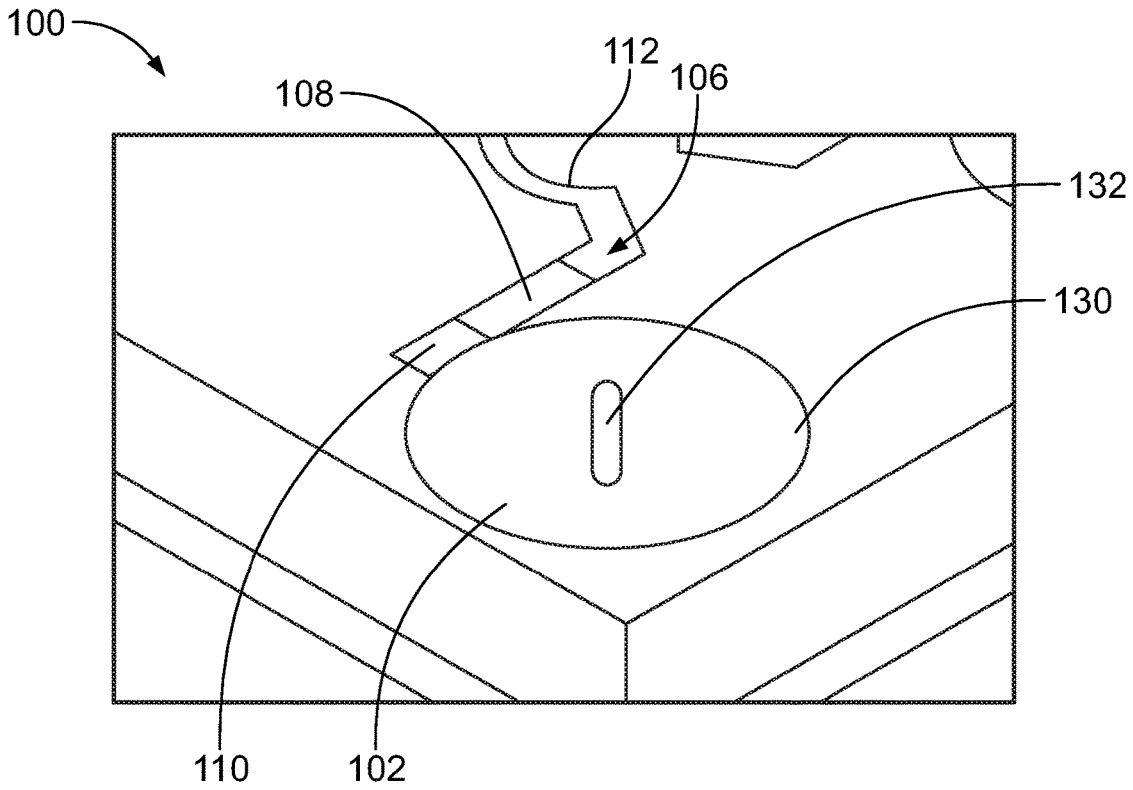
FIG. 2 illustrates a perspective top view of a resistor proximate to an antenna element of the antenna assembly.

FIG. 2 illustrates a perspective top view of a resistor 108 proximate to an antenna element 102 of the antenna assembly 100. The resistor 108 is disposed on and/or within the microstrip feed network 106, such as on or within a power inlet segment 110 that electrically couples the antenna element 102 to a power divider 112.

In at least one embodiment, the resistors 108 are printed resistive elements. For example, the resistors 108 may be additively printed, such as via liquid dispensing, aerosol jet dispensing, ink-jet dispensing, screen printing, and/or the like. Alternatively, the resistors 108 may be additively printed through film deposition techniques such as chemical vapor deposition, atomic layer deposition, and physical vapor deposition.

As non-limiting examples, attenuation of a resistor 108 near 10 GHz is −3.4 dB for 1 mm length, −6.9 dB for 2 mm length, and −10.4 dB for 3 mm length. Attenuation for a 3 mm length resistor 108 varies less than 0.2 dB across the antenna frequency range of 9.65 to 10.5 GHz.

As shown in FIGS. 1 and 2, the antenna elements 102 may include circular-shaped main bodies 130 with an interior inclusive slot 132 formed therein. Current travels along the microstrip feed network 106, then electrically couples to the antenna element 102 having the inclusive slot 132. The slot 132 of each antenna element 102 increases bandwidth and decreases the axial ratio (decreases the polarization loss). That is, the slot 132 forces current to rotate around the antenna element 102. Alternatively, the antenna elements 102 may be sized and shaped differently than shown. For example, the antenna elements 102 may have a rectangular axial cross section. In at least one other embodiment, at least one of the antenna elements 102 may not include a slot 132.

Figure 3:
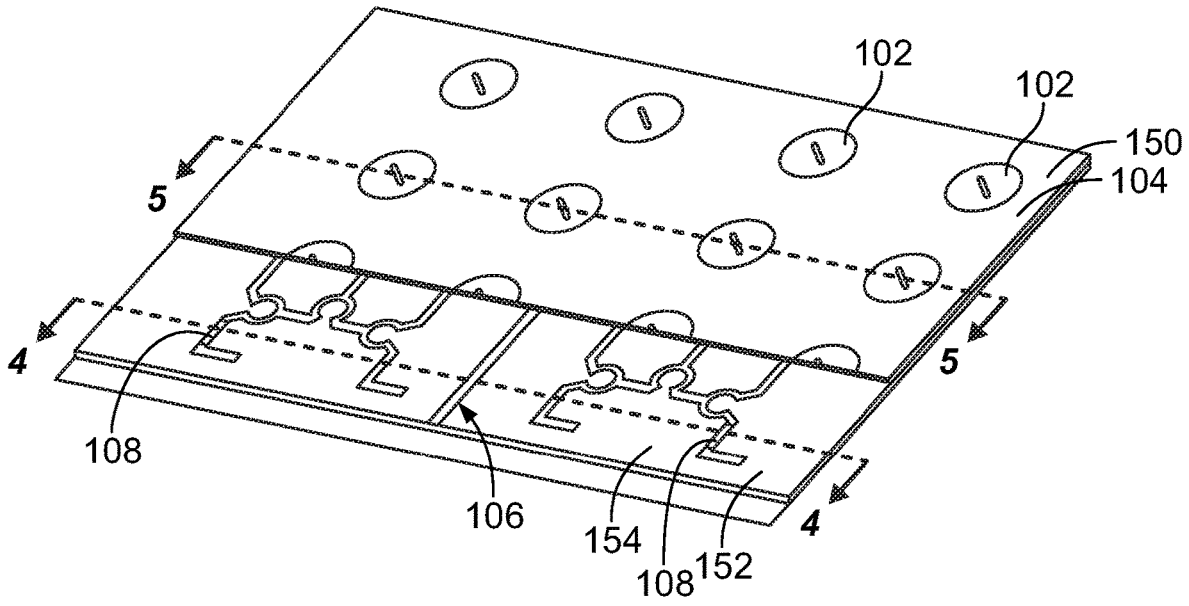
FIG. 3 illustrates a perspective top view of the antenna assembly, according to an embodiment of the present disclosure.

FIG. 3 illustrates a perspective top view of the antenna assembly 100, according to an embodiment of the present disclosure. The antenna elements 102 are disposed on a top layer 150, such as the first dielectric 104. The microstrip feed network 106 is embedded within the antenna assembly 100, and disposed on an internal layer 152, such as a second dielectric 154, underneath the top layer 150. A portion of the top layer 150 is removed in FIG. 3 in order to show the microstrip feed network 106. Alternatively, the microstrip feed network 106 and the antenna elements 102 may both be disposed on a common layer.

Figure 4:
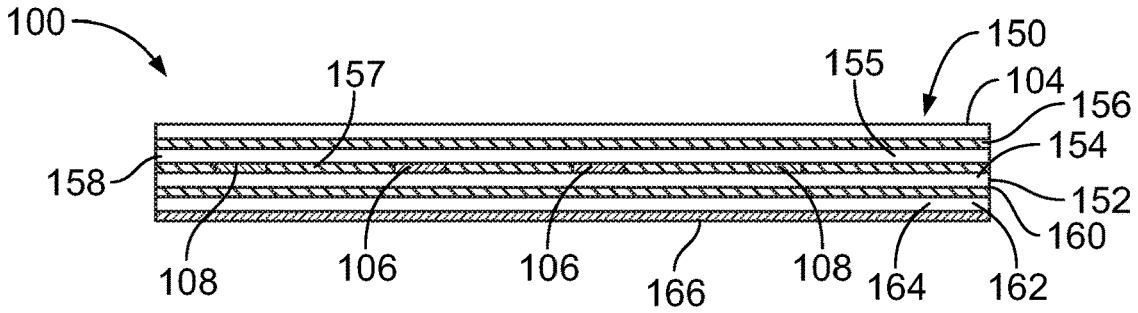
FIG. 4 illustrates a cross-sectional view of the antenna assembly through line 4-4 of FIG. 3.

FIG. 4 illustrates a cross-sectional view of the antenna assembly 100 through line 4-4 of FIG. 3. An adhesive layer 156 may be sandwiched between the top layer 150 and a first spacer layer 155, such as a third dielectric 158. The microstrip feed network 106 and the resistors 108 disposed thereon and/or therein are disposed on the internal layer 152, such as the second dielectric 154. An adhesive layer 157 may be sandwiched between the internal layer 152 and the first spacer layer 155. An adhesive layer 160 may be sandwiched between the internal layer 152 and a second spacer layer 162, such as a fourth dielectric 164. A ground plane 166 is secured to a backside of the antenna assembly 100, such as underneath the second spacer layer 162. Optionally, the antenna assembly 100 may not include one or both of the first spacer layer 155 and/or the second spacer layer 162.

Each dielectric layer may be formed using a combination of subtractive (for example, laser etching milling, or wet etching) and additive (for example, printing or film deposition) processes. The various layers may then be aligned and bonded, such as through lamination with adhesive films, to form the antenna assembly 100.

Figure 5:
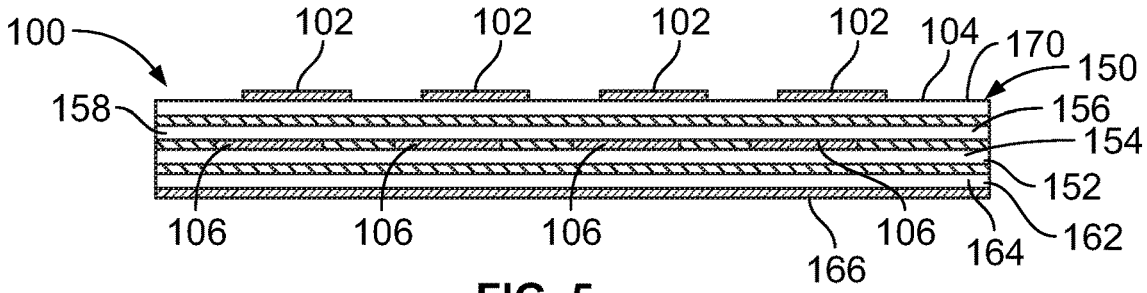
FIG. 5 illustrates a cross-sectional view of the antenna assembly through line 5-5 of FIG. 3.

FIG. 5 illustrates a cross-sectional view of the antenna assembly 100 through line 5-5 of FIG. 3. As shown, the antenna elements 102 are disposed on a top, exposed surface 170 of the top layer 150, while the microstrip feed network 106 is embedded within the antenna assembly 100 below the top layer 150.

Referring to FIGS. 4 and 5, the top layer 150, the first spacer layer 155, the internal layer 152, and the second spacer layer 162 may be formed through subtractive pattern copper and/or additive print ink. The resistors 108 may be printed on the internal layer 152.

Figure 6:
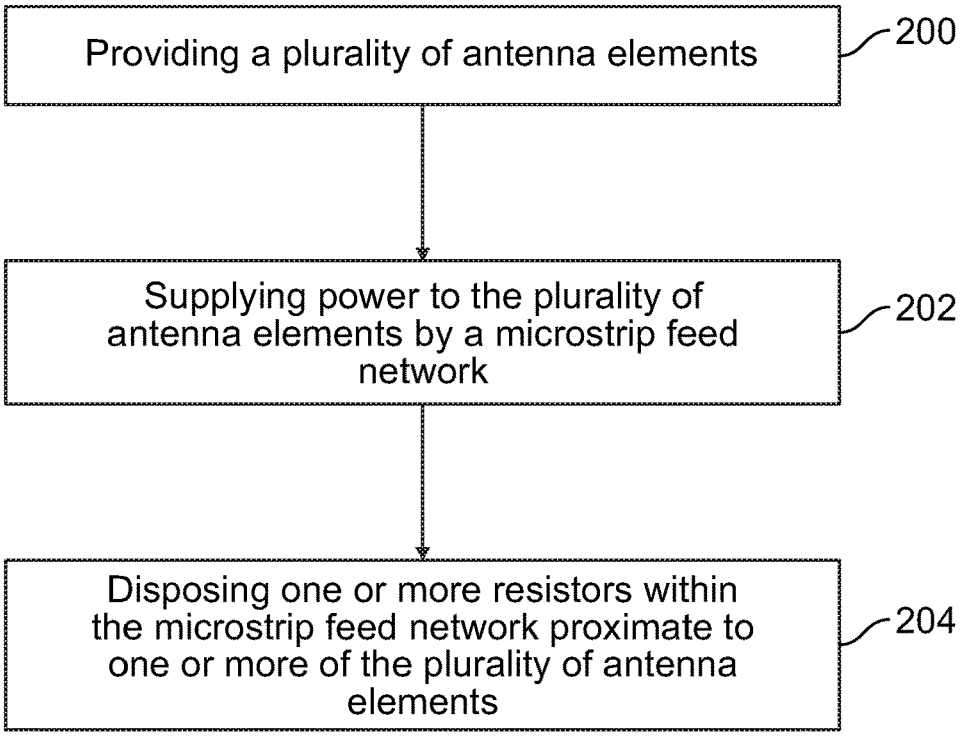
FIG. 6 illustrates a flow chart of a method of controlling sidelobes of an antenna assembly, according to an embodiment of the present disclosure.

FIG. 6 illustrates a flow chart of a method of controlling sidelobes of an antenna assembly, according to an embodiment of the present disclosure. The method includes providing (200) a plurality of antenna elements, supplying (202) power to the plurality of antenna elements by a microstrip feed network, and disposing (204) one or more resistors within the microstrip feed network proximate to one or more of the plurality of antenna elements. In at least one embodiment, the method includes embedding the resistors within the antenna assembly. Said providing the plurality of antenna elements may include disposing the plurality of antenna elements on a first dielectric above the microstrip feed network. The method may also include disposing the microstrip feed network and the resistors on a second dielectric below the first dielectric.

In at least one embodiment, said disposing the one or more resistors includes disposing the one or more resistors in power inlet segments that electrically couple to the one or more of the plurality of antenna elements. In at least one embodiment, said disposing the one or more resistors includes disposing a plurality of resistors proximate to a subset of the antenna elements located at or otherwise proximate to a periphery of the antenna assembly. In at least one embodiment, said disposing the one or more resistors includes disposing a plurality of resistors in the microstrip feed network proximate to corners of the antenna assembly. The resistors may not be proximate to the interior main antenna elements.

As described herein, embodiments of the present disclosure provide cost-effective antenna assemblies that are configured to efficiently reduce sidelobes. The antenna assemblies includes resistors proximate to one or more antenna elements. The resistors control (for example, suppress) sidelobes.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. An antenna assembly, comprising:

a plurality of antenna elements;

a microstrip feed network configured to supply power to the plurality of antenna elements; and one or more resistors disposed within the microstrip feed network proximate to one or more of the plurality of antenna elements, wherein the one or more resistors are printed resistors embedded within the antenna assembly, wherein the plurality of antenna elements are disposed on a first dielectric above the microstrip feed network, and wherein the one or more resistors are configured to control sidelobes of the antenna assembly.

2. The antenna assembly of claim 1, wherein the microstrip feed network and the one or more resistors are disposed on a second dielectric below the first dielectric.

3. The antenna assembly of claim 1, wherein the one or more resistors are disposed in power inlet segments that electrically couple to the one or more of the plurality of antenna elements.

4. The antenna assembly of claim 1, wherein the one or more resistors comprise a plurality of resistors proximate to a subset of the antenna elements located at or otherwise proximate to a periphery of the antenna assembly.

5. The antenna assembly of claim 1, wherein the one or more resistors comprises a plurality of resistors disposed in the microstrip feed network proximate to corners of the antenna assembly.

6. The antenna assembly of claim 1, wherein the plurality of antenna elements comprise:

corner antenna elements;

peripheral interior antenna elements between the corner antenna elements; and interior main antenna elements proximate to a center of the antenna assembly, wherein the one or more resistors are not proximate to the interior main antenna elements.

7. The antenna assembly of claim 6, wherein the one or more resistors comprises a first plurality of resistors proximate to the corner antenna elements.

8. The antenna assembly of claim 7, wherein the one or more resistors further comprises a second plurality of resistors proximate to the peripheral interior antenna elements.

9. The antenna assembly of claim 1, further comprising a ground plane disposed below the microstrip feed network.

10. The antenna assembly of claim 1, wherein the printed resistors are printed onto or into a power inlet segment.

11. The antenna assembly of claim 1, wherein the printed resistors are additively printed via liquid dispensing, aerosol jet dispensing, screen printing, chemical vapor deposition, atomic layer deposition, or physical vapor deposition.

12. A method of controlling sidelobes of an antenna assembly, the method comprising:

providing a plurality of antenna elements;

supplying power to the plurality of antenna elements by a microstrip feed network;

disposing one or more resistors within the microstrip feed network proximate to one or more of the plurality of antenna elements, wherein said disposing comprises embedding the one or more resistors within the antenna assembly, and wherein said embedding comprises printing resistors within the antenna assembly to form the one or more resistors, and wherein said providing the plurality of antenna elements comprises disposing the plurality of antenna elements on a first dielectric above the microstrip feed network.

13. The method of claim 12, further comprising disposing the microstrip feed network and the one or more resistors on a second dielectric below the first dielectric.

14. The method of claim 12, wherein said disposing the one or more resistors comprises disposing the one or more resistors in power inlet segments that electrically couple to the one or more of the plurality of antenna elements.

15. The method of claim 12, wherein said disposing the one or more resistors comprises disposing a plurality of resistors proximate to a subset of the antenna elements located at or otherwise proximate to a periphery of the antenna assembly.

16. The method of claim 12, wherein said disposing the one or more resistors comprises disposing a plurality of resistors in the microstrip feed network proximate to corners of the antenna assembly.

17. The method of claim 12, wherein said printing comprises additively printing via liquid dispensing, aerosol jet dispensing, screen printing, chemical vapor deposition, atomic layer deposition, or physical vapor deposition.

18. The method of claim 12, wherein said printing comprises printing the printed resistors onto or into a power inlet segment.

19. An antenna assembly, comprising:

a plurality of antenna elements disposed on a first dielectric, wherein the plurality of antenna elements comprise corner antenna elements, peripheral interior antenna elements between the corner antenna elements, and interior main antenna elements proximate to a center of the antenna assembly;

a microstrip feed network configured to supply power to the plurality of antenna elements; and a first plurality of resistors disposed within the microstrip feed network proximate to the corner antenna elements, wherein the one or more resistors are printed resistors embedded within the antenna assembly, and wherein the first plurality of resistors are not proximate to the interior main antenna elements, wherein the microstrip feed network and the first plurality of resistors are disposed on a second dielectric below the first dielectric; and wherein the first plurality of resistors are configured to control sidelobes of the antenna assembly.

20. The antenna assembly of claim 19, further comprising a second plurality of resistors proximate to the peripheral interior antenna elements, wherein the second plurality of resistors are not proximate to the interior main antenna elements.

* * * * *